United States Patent [19]

Lash et al.

[11] 4,104,137

[45] Aug. 1, 1978

[54] ALLOY PLATING

[75] Inventors: Ronald J. Lash, Warren; Otto Kardos, Ferndale, both of Mich.

[73] Assignee: M&T Chemicals Inc., Stamford, Conn.

[21] Appl. No.: 805,410

[22] Filed: Jun. 10, 1977

[51] Int. Cl.[2] ..... C25D 3/56

[52] U.S. Cl. ..... 204/43 T

[58] Field of Search ..... 204/43 T, 48, 112, 123, 204/113

[56] References Cited

U.S. PATENT DOCUMENTS

| | | | |
|---|---|---|---|
| 3,354,059 | 11/1967 | Koretzky | 204/43 T X |
| 4,036,709 | 7/1977 | Harbulak | 204/43 T |

*Primary Examiner*—G. L. Kaplan

*Attorney, Agent, or Firm*—Kenneth G. Wheeless; Robert Spector

[57] ABSTRACT

In accordance with certain of its aspects, this invention relates to a process for the preparation of an electrodeposit which contains iron and at least one metal selected from the group consisting of nickel and cobalt which comprises passing current from an anode to a cathode through an aqueous plating solution containing an iron compound and at least one member selected from the group consisting of cobalt compounds and nickel compounds providing cobalt or nickel ions for electrodepositing alloys of iron with cobalt and/or nickel and containing an effective amount of at least one substituted or unsubstituted dihydroxybenzene complexing agent.

18 Claims, No Drawings

ALLOY PLATING

DESCRIPTION OF THE INVENTION

This invention relates to the electrodeposition of iron alloys of nickel and/or cobalt using an improved process and composition by passing a current from an anode to a cathode through an acidic aqueous plating solution which contains at least one iron compound and nickel or cobalt or nickel and cobalt compounds to provide nickel, cobalt and iron ions for electrodepositing alloys of nickel-iron or cobalt-iron or nickel-cobalt-iron. Such alloys are comparable to 100 percent nickel deposits in brightness, leveling and corrosion properties and are a satisfactory substrate for chromium deposition.

It is known in the art of nickel-iron electroplating that the presence of excessive amounts of trivalent iron, which easily forms especially in air agitated baths, tends to produce deposits with unsightly adverse qualities by precipitating basic iron salts in the cathode film as well as in the bulk of the solution. In order to reduce the iron (III) activity in the plating solution and to prevent such problems, nickel-iron plating solutions heretofore contain an iron complexing agent in the form of hydroxy substituted lower aliphatic carboxylic acids having from 2–8 carbon atoms such as citric acid described by Brown (U.S. Pat. No. 2,800,440) and Clauss et al. (U.S. Pat. No. 3,806,429); gluconic acid, glucoheptonate, glycollic acid and the like are used by Clauss and Tremmel (U.S. Pat. No. 3,795,591). Others attempt to reduce the trivalent iron to the divalent state; Tremmel employs a reducing saccharide (U.S. Pat. No. 3,974,044) and Koretzky (U.S. Pat. No. 3,354,059) utilizes ascorbic or isoascorbic acid. However these compounds can reduce leveling and undergo decomposition which results in the formation of insoluble degradation salts with nickel ions. These products precipitate from the plating solution and collect on the anode bags and on the filter causing them to become clogged; this produces anode polarization problems and filter stoppages. Since these complexing and reducing agents are counter-leveling, more metal is required on poorly buffed or unbuffed basis metals which results in longer plating times and increased costs. Less complexing agents could be used if conditions which favor less ferric ion formation could be implemented, such as operating the plating bath at a lower pH. However, lower pH values reduce leveling even further in these baths, only adding to the dilemma.

It is therefore the purpose of this invention to provide a method and composition for the electrodeposition of bright nickel-iron or cobalt-iron alloys of higher iron content, generally on the order of 15 to 70 percent iron, and with greater leveling at lower pH and free from formation of insoluble degradation salts with nickel ions and free from the precipitation of basic iron salts.

Such deposits are suitable substrates for the electrodeposition of decorative or functional chromium, which increases the corrosion resistance of the basis metal such as steel with or without an initial layer of electrodeposited semi-bright nickel, copper or the like.

The aqueous plating solution described in this invention contains soluble iron compounds to provide iron ions, soluble nickel compounds to provide nickel ions and/or soluble cobalt compounds to provide cobalt ions. Although the highest percentage of total iron in the bath is in the preferred divalent state, the solution also contains an amount of ferric ion due to air and/or anodic oxidation or iron (II). The electrolyte also contains an aromatic compound of the type described below, capable of acting as an antioxidant, reducing agent or complexing agent. The bath may also contain suitable nickel or nickel-iron Class I additives such as the sulfo-oxygen compounds including aromatic sulfonates, aliphatic olefinically or acetylenically unsaturated sulfonates, sulfonamides, or sulfonimides. Class II acetylenic, heterocyclic nitrogen, nitrile, dyestuffs etc. nickel brighteners may also be used in cooperation with sulfo-oxygen compounds.

The complexing agent which is utilized in this invention consists of a dihydroxybenzene compound which may or may not contain additional water solubilizing groups e.g. carboxy, —COOH, or sulfo, —$SO_3H$. Complexing compounds typical of those described in this invention are of the formula:

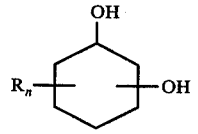

Where R is independently hydrogen, sulfo or carboxy, and $n$ is an integer 0, 1, or 2 and where the aromatic ring may additionally be polycyclic. The carboxy or sulfo group may be the free acid or a water soluble salt thereof such as with the alkali metals etc. It is also understood that any other bath inert substituents such as halogens, alkoxy groups etc. may also be present.

Typical compounds covered by the above generalized structure may include:

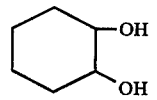

o-dihydroxybenzene

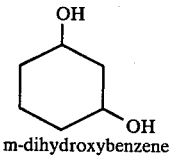

m-dihydroxybenzene

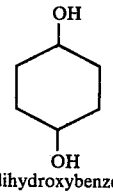

p-dihydroxybenzene

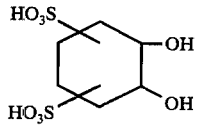

o-dihydroxybenzene disulfonic acid

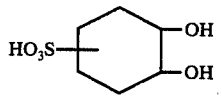

o-dihydroxybenzene sulfonic acid

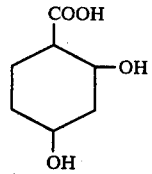

2,4-dihydroxybenzoic acid

Especially useful compounds include o-dihydroxybenzene and o-dihydroxybenzene disulfonic acid and their salts.

Operation of Invention

In order to deposit iron alloys of nickel or cobalt according to the various aspects of this invention, a bath is prepared containing nickel salts such as nickel sulfate and/or nickel chloride which are usually present in the concentration range of 50 to 300 grams per liter and 100 to 275 grams per liter respectively. The iron may be introduced into the bath from the chemical or electrochemical oxidation of the iron anodes or it may be introduced in the form of ferrous sulfate or ferrous chloride; the ferrous salts are normally employed at a concentration of about 5 to 100 grams per liter. Although the greatest percentage of the total iron in the bath is in the preferred divalent state, trivalent iron is also present due to air or anodic oxidation of iron (II). The trivalent iron may be present in the bath from a few parts per million to about 5 grams per liter but preferably less than one gram per liter. This invention may also include a nickel bath containing ferric iron as an impurity.

Antioxidant and complexing compounds typical of those described in this invention are o-dihydroxybenzene and o-dihydroxybenzene disulfonic acid which are utilized in amounts from 1 to 50 grams per liter. It is understood that water soluble salts of these compounds such as ammonium and alkali metal salts may also be used.

The function of the antioxidant and complexing agent is to inhibit the oxidation of ferrous ions to ferric ions and/or to coordinate ferric ions in solution. The complexed ferric ion can then be reduced chemically by the oxidation of the dihydroxy moiety to form quinone or electrochemically at the cathode surface. The complex precludes the formation of basic iron salts thus allowing the transport of soluble iron (III) to the cathode where it may be reduced. The antioxidant and complexing agent described in this invention may be used alone or in combination with other complexing agents, e.g. the hydroxy aliphatic carboxylic acids; for example, gluconic acid, citric acid, glycollic acid, ascorbic acid, isoascorbic acid, etc. It has also been found that bisulfites and formaldehyde adducts thereof as well as organic sulfinates are advantageous in combination with the dihydroxyaryls of this invention in achieving greater tolerance to higher concentration of the antioxidant and complexing agent. The sulfites, bisulfites and sulfinates are normally used in the concentration range between 0.1 and 5 grams per liter. The novel and unexpected aspects of this invention are:

1. The antioxidant and complexing agent is not counter-leveling.
2. The antioxidant and complexing agent allows operation below pH 3.0 (lower pH values inhibit the formation of ferric ions) without a reduction in leveling as observed with other systems.
3. The complex does not degrade with electrolysis to insoluble products which precipitate and clog anode bags and filters and produce rough deposits.

Thus, the antioxidants and complexing agents of this invention promote the electrodeposition of an alloy of higher iron content with increased brightness and leveling. Deposits have low stress, excellent ductility and superb chromium receptivity.

The concentration of the antioxidant and complexing agent in the bath may range from 1 to 50 grams per liter with a preferred concentration range of about 2 to 15 grams per liter. Nickel or nickel-iron brightening additives may additionally be utilized to further promote luster, ductility and leveling in the deposits.

Suitable nickel additives that have been found effective are the sulfo-oxygen compounds including aromatic sulfonates, sulfonamides, sulfonimides, sulfinates; aliphatic or aromatic-aliphatic olefinically or acetylenically unsaturated sulfonates, sulfonamides, or sulfonimides; and aldehyde bisulfite adducts. Such compounds may be used singly or in combination and can be employed in the present invention from 0.5 to 10 grams per liter. Specific examples of such additives are:

1. o-benzoic-sulfimide sodium salt
2. sodium benzene monosulfonate
3. sodium allyl sulfonate
4. sodium $\beta$-styrene sulfonate For bright, well-leveled alloy plating, acetylenic nickel brighteners may also be used in cooperation with a sulfo-oxygen compound. Suitable compounds are: 1,4-di-($\beta$-hydroxyethoxy)-2-butyne, sodium 2-butynoxy-1,4-di(ethane sulfonate), propargyl alcohol, ethoxylated propargyl alcohol, or those described in U.S. Pat. No. 3,922,209.

Various buffers may also be used in the bath such as boric acid, sodium acetate, citric acid, etc. The concentration may range from 20 grams per liter to saturation; preferably, about 45 grams per liter.

Wetting agents may be added to the electroplating baths of this invention to reduce the surface tension of the solution and to reduce pitting. These organic materials with surfactant properties also function to make the baths more compatible with contaminants such as oil, grease, etc. by their emulsifying, dispersing, and solubilizing action on such contaminants and thereby promote attaining of sounder deposits. Organic surfactants commonly used are exemplified by the following: sodium lauryl sulfate, sodium lauryl ether sulfate and sodium di-alkylsulfosuccinate.

The pH of all the foregoing illustrative aqueous iron-nickel containing, cobalt-iron containing and nickel-cobalt-iron containing compositions may be maintained during plating at pH values of 2.0 to 5.0 and preferably from 2.5 to 3.0 During bath operation, the pH may normally tend to rise and may be adjusted with acids such as hydrochloric acid or sulfuric acid, etc.

Agitation of the above baths during plating may consist of solution pumping, moving cathode rod, air agitation or combinations thereof.

Anodes used in the above baths may consist of the particular single metals being plated at the cathode such as iron and nickel, for plating nickel-iron, cobalt and iron, for plating cobalt-iron, or nickel, cobalt and iron, for plating nickel-cobalt-iron alloys. The anodes may consist of the separate metals involved suitably suspended in the bath as bars, strips or as small chunks in titanium baskets. In such cases the ratio of the separate metal anode area is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath metal ion imbalance, occasional adjustments may be made by adding the appropriate corrective concentration of the individual metal salts. All anodes or anode baskets are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-iron, cobalt-iron or nickel-cobalt-iron containing electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel; copper; alloys of copper such as brass, bronze, etc.; zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the nickel-iron, cobalt-iron and nickel-cobalt-iron containing electroplate applied on such substrates.

The operating temperature of the bath may range from about 30° to 70° C, preferably 50° to 60° C.

The average cathode current density may range from about 0.5 to 20 ampere per square decimeter, preferably about 4 ampere per square decimeter.

The following examples are submitted to further the understanding of the operation of the invention and are not to be construed as limiting its scope.

EXAMPLE I

A nickel-iron bath was prepared having the following composition:

$NiSO_4.6H_2O$: 130 g/l
$NiCl_2.6H_2O$: 90 g/l
$FeSO_4.7H_2O$: 52 g/l
$H_3BO_3$: 49 g/l
Sodium Gluconate: 20 g/l
Sodium Saccharinate: 3.5 g/l
Sodium Allyl Sulfonate: 3.5 g/l
1,4-Di-(β-Hydroxyethoxy)-2-butyne: 0.05–0.1 g/l
Temperature: 54° C
Air Agitation Both brass and steel test panels were used on which a band was scribed with a single pass of 4/0 grit emery. The panels were plated in a 267 ml. Hull Cell at 2 amperes for 10 minutes. The resulting deposits from this solution were bright but had poor ductility and were dark in the low current density region. The leveling, although fair at pH 3.5, became almost non-existent when the test was repeated at a pH of 2.8. The iron content in the deposit was found by analysis to be 44 percent iron.

EXAMPLE II

The tests of Example I were repeated using 2 grams per liter of o-dihydroxybenzene in place of the sodium gluconate. The resulting deposits were fully bright, had excellent ductility and possessed exceptionally good leveling at pH 2.5. The deposits were bright and clear in the low current density region and showed very good throwing power. Upon analysis, the deposit was found to contain 50 percent iron.

EXAMPLE III

A four liter nickel-iron bath was prepared having the following composition:

$NiSO_4.6H_2O$: 100 g/l
$NiCl_2.6H_2O$: 95 g/l
$FeSO_4.7H_2O$: 40 g/l
$H_3BO_3$: 49 g/l
Sodium Gluconate: 25 g/l
Sodium Saccharinate: 3.0 g/l
Sodium Allyl Sulfonate: 3.0 g/l
1,4-Di-(β-Hydroxyethoxy)-2-butyne: 0.05–0.1 g/l
pH: 3.5
Temperature: 54° C
Air Agitation Extended electrolysis of this solution over several hundred ampere-hours per gallon caused insoluble degradation products to be formed which precipitated as a nickel salt, much of which accumulated on the walls of the plating vessel, and on the anode bags. This resulted in anode polarization problems which only accelerated the degradation causing adverse effects on the deposit from free ferric ions. Adding more gluconate to complex the ferric ions reduced leveling and contributed to the formation of additional degradation products in the solution and on the anode bags. During plating, these degradation products can settle on the shelf areas of the cathode causing roughness.

EXAMPLE IV

The tests of Example III were repeated at pH 2.8 using 5 grams per liter of o-dihydroxybenzene sodium disulfonate and 1 gram per liter sodium formaldehyde bisulfite in place of sodium gluconate. Upon extended electrolysis over several hundred ampere-hours per gallon, there were no adverse effects on the deposit from ferric ions; there was no precipitation of basic ferric salts in the bath; there was no formation of insoluble degradation products; and there was no loss of leveling due to the complexing agent or the lowered operating pH of the bath. Thus, the efficacy of the o-dihydroxybenzene sodium disulfonate in preventing undesirable side effects is demonstrated.

EXAMPLE V

A nickel-iron bath was prepared and analyzed with the following results:

$NiSO_4.6H_2O$: 128 g/l
$NiCl_2.6H_2O$: 92 g/l
$Ni^{+2}$: 51 g/l
$H_3BO_3$: 49 g/l
Fe (Total): 7.8 g/l
$Fe^{+3}$: 0.20 g/l
Sodium Saccharinate: 3.3 g/l
Sodium Allyl Sulfonate: 3.8 g/l
1,4-Di-(β-Hydroxyethoxy)-2-butyne: 0.08 g/l
pH: 2.7
Temperature: 56° C
Air Agitation After electrolyzing this solution in a Hull Cell for 30 minutes at a cell current of 2 amperes, it became very turbid from the formation of basic ferric salts even at this low pH.

EXAMPLE VI

The test of Example V was repeated with the following addition:

o-Dihydroxybenzene Disodium Sulfonate: 3 g/l

After electrolysis in a Hull Cell for 60 minutes at a cell current of 2 amperes, the solution was still clear and completely free of basic ferric salt precipitation. This demonstrates the effectiveness of the o-dihydroxybenzene disodium sulfonate in preventing precipitation of basic iron salts.

What is claimed is:

1. A process for the preparation of an electrodeposit which contains iron and at least one metal selected from the group consisting of nickel and cobalt which comprises passing current from an anode to a cathode through an aqueous acidic plating solution containing an iron compound and at least one member selected from the group consisting of cobalt compounds and nickel compounds providing cobalt or nickel ions for electrodepositing alloys of iron with cobalt and/or nickel and containing 1 to 50 g/l of at least one substituted or unsubstituted dihydroxybenzene complexing agent.

2. The process of claim 1 wherein said dihydroxybenzene complexing agent is of the formula:

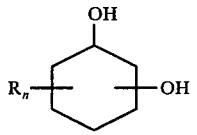

where R is independently hydrogen, sulfo or carboxy, and *n* is an integer 0, 1, or 2; where the aromatic ring may additionally be naphthalene; where the carboxy or sulfo group is a free acid or a water soluble salt thereof; and where other bath inert substituents such as halogens, alkoxy groups etc. may also be present.

3. The process of claim 2 wherein said complexing agent is o-dihydroxybenzene.

4. The process of claim 2 wherein said complexing agent is m-dihydroxybenzene.

5. The process of claim 2 wherein said complexing agent is p-dihydroxybenzene.

6. The process of claim 2 wherein said complexing agent is o-dihydroxybenzene disulfonic acid.

7. The process of claim 2 wherein said complexing agent is o-dihydroxybenzene sulfonic acid.

8. The process of claim 2 wherein said complexing agent is 2,4-dihydroxybenzoic acid.

9. In a process for the preparation of an iron alloy electrodeposit which contains nickel, cobalt, or nickel and cobalt, which comprises passing current from an anode to a cathode through an aqueous acidic plating solution containing at least one ferrous compound and at least one nickel compound, at least one cobalt compound, or a combination of nickel and cobalt compounds, providing ions for electrodepositing nickel-iron alloy, cobalt-iron alloy, or nickel-cobalt-iron alloy, the improvement comprising in combination 1 to 50 g/l of at least one substituted or unsubstituted dihydroxybenzene complexing agent in combination with at least one member of the group consisting of organic sulfo-oxygen compounds, acetylenic brighteners, and hydroxy aliphatic carboxylic acids.

10. In an aqueous acidic electroplating solution containing nickel compounds, cobalt compounds and ferrous compounds, providing ions for electrodepositing nickel-cobalt-iron alloy, the improvement comprising the presence of a dihydroxybenzene complexing agent.

11. The solution of claim 10 wherein said complexing agent is of the formula:

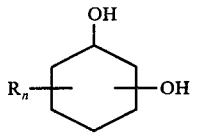

where R is independently hydrogen, sulfo or carboxy, and *n* is an integer 0, 1, or 2; where the aromatic ring may additionally be naphthalene; where the carboxy or sulfo group is a free acid or a water soluble salt thereof; and where other bath inert substituents such as halogens, alkoxy groups etc. may also be present.

12. The solution of claim 11 wherein said complexing agent is o-dihydroxybenzene.

13. The solution of claim 11 wherein said complexing agent is m-dihydroxybenzene.

14. The solution of claim 11 wherein said complexing agent is p-dihydroxybenzene.

15. The solution of claim 11 wherein said complexing agent is o-dihydroxybenzene disulfonic acid.

16. The solution of claim 11 wherein said complexing agent is o-dihydroxybenzene sulfonic acid.

17. The solution of claim 11 wherein said complexing agent is 2,4-dihydroxybenzoic acid.

18. An aqueous acidic electroplating solution which contains ferrous sulfate or ferrous chloride, and nickel compounds or nickel and cobalt compounds providing nickel or nickel and cobalt ions for electrodepositing nickel-iron, cobalt-iron, or nickel-cobalt-iron, containing in combination 1 to 50 g/l of at least one substituted or unsubstituted dihydroxybenzene complexing agent in combination with at least one member of the group consisting of organic sulfo-oxygen compounds, acetylenic brighteners, and hydroxy aliphatic carboxylic acids.

* * * * *